US009622003B2

(12) United States Patent
Schmidt et al.

(10) Patent No.: US 9,622,003 B2
(45) **Date of Patent: *Apr. 11, 2017**

(54) SPEAKER LOCALIZATION

(71) Applicant: NUANCE COMMUNICATIONS, INC., Burlington, MA (US)

(72) Inventors: Gerhard Uwe Schmidt, Ulm (DE); Tobias Wolff, Ulm (DE); Markus Buck, Biberach (DE); Olga Gonzalez Valbuena, Palencia (ES); Gunther Wirsching, Eischstatt (DE)

(73) Assignee: NUANCE COMMUNICATIONS, INC., Burlington, MA (US)

( * ) Notice: Subject to any disclaimer, the term of this patent is extended or adjusted under 35 U.S.C. 154(b) by 175 days.

This patent is subject to a terminal disclaimer.

(21) Appl. No.: 14/178,309

(22) Filed: Feb. 12, 2014

(65) Prior Publication Data

US 2014/0247953 A1 Sep. 4, 2014

Related U.S. Application Data

(63) Continuation of application No. 12/742,907, filed as application No. PCT/EP2008/009714 on Nov. 17, 2008, now Pat. No. 8,675,890.

(30) Foreign Application Priority Data

Nov. 21, 2007 (EP) ..... 07022602

(51) Int. Cl.
*H04R 3/00* (2006.01)
*H04R 29/00* (2006.01)
(Continued)

(52) U.S. Cl.
CPC ..... *H04R 29/00* (2013.01); *G10L 21/0272* (2013.01); *H04R 3/005* (2013.01); *G10L 2021/02166* (2013.01)

(58) Field of Classification Search
CPC ..... H04R 3/005
(Continued)

(56) References Cited

U.S. PATENT DOCUMENTS 6,526,147 B1 * 2/2003 Rung ..... H04R 3/005 381/111
6,826,284 B1 11/2004 Benesty et al.
(Continued)

FOREIGN PATENT DOCUMENTS

EP 1 736 964 A 12/2006
EP 2 063 419 A1 5/2009
(Continued)

OTHER PUBLICATIONS

International Search Report, PCT/EP2008/009714, date of mailing Jan. 13, 2009, 5 pages.
(Continued)

*Primary Examiner* — Alexander Jamal
(74) *Attorney, Agent, or Firm* — Daly, Crowley Mofford & Durkee, LLP

(57) ABSTRACT

Methods and apparatus for determining phase shift information between the first and second microphone signals for a sound signal, and determining an angle of incidence of the sound in relation to the first and second positions of the first and second microphones from the phase shift information of a band-limited test signal received by the first and second microphones for a frequency range of interest.

19 Claims, 3 Drawing Sheets

(51) Int. Cl.
*G10L 21/0272* (2013.01)
*G10L 21/0216* (2013.01)

(58) Field of Classification Search
USPC ..... 381/92
See application file for complete search history.

(56) References Cited

U.S. PATENT DOCUMENTS

| | | | | |
|---|---|---|---|---|
| 7,817,805 | B1 * | 10/2010 | Griffin | G01S 3/807 367/103 |
| 8,565,446 | B1 * | 10/2013 | Ebenezer | H04R 3/005 381/122 |
| 8,675,890 | B2 * | 3/2014 | Schmidt | G10L 21/0272 381/92 |
| 2004/0037436 | A1 * | 2/2004 | Rui | H04R 3/005 381/92 |
| 2004/0165735 | A1 * | 8/2004 | Opitz | H04R 1/406 381/92 |
| 2009/0175466 | A1 * | 7/2009 | Elko | H04R 3/005 381/94.2 |
| 2010/0017205 | A1 * | 1/2010 | Visser | G10L 21/02 704/225 |

FOREIGN PATENT DOCUMENTS

| | | |
|---|---|---|
| WO | WO 03/003349 | 1/2003 |
| WO | WO 2009/065542 A1 | 5/2009 |

OTHER PUBLICATIONS

Written Opinion, PCT/EP2008/009714, date of mailing Jan. 13, 2009, 8 pages.

International Preliminary Report on Patentability, PCT/EP2008/009714, date of issuance May 25, 2010, 1 page.

Mitsunori Mizumachi and Satoshi Nakamura et al.: "Noise Reduction using Paired-microphones on Non-equally-spaced Microphone Arrangement" Eurospeech 2003, Sep. 2003, p. 585, XP007006702, Geneva, CH.

European Search Report and Written Opinion dated Jul. 11, 2008; for European Pat. App. No. EP 07022602.2; 9 pages.

Amendments to Claims filed Jun. 15, 2009; for European Pat. App. No, EP 07022602.2; 8 pages.

European Office Action dated Dec. 27, 2010; for European Pat. App. No. Ep 07022602.2; 4 pages.

European Response filed Apr. 29, 2011 to the Office Action dated Dec. 27, 2010; for European Pat. App. No. EP 07022602.2; 16 pages.

European Summons to Attend Oral Proceedings dated Jun. 1, 2011; for European Pat. App. No. EP 07022602.2; 4 pages.

European Result of Telephonic Consultation with Examiner dated Jul. 12, 2011; for European Pat. App. No. EP 07022602.2; 2 pages.

European Response filed on Aug. 3, 2011 to Summons to Attend Oral Proceedings dated Jun. 1, 2011; for European Pat. App. No. EP 07022602.2; 29 pages.

European Intention to Grant with Allowed Text and Claims dated Aug. 26, 2011; for European Pat. App. No. EP 07022602.2; 43 pages.

European Request for Correction dated Jan. 3, 2012; for European Pat. App. No. EP 07022602.2; 9 pages.

European Decision to Grant dated Mar. 22, 2012; for European Pat. App. No. EP 07022602.2; 2 pages.

Notice of Allowance dated Nov. 22, 2013; for U.S. Appl. No. 12/742,907; 14 pages.

* cited by examiner

SPEAKER LOCALIZATION

CROSS REFERENCE TO RELATED APPLICATIONS

The present application is a continuation of U.S. patent application Ser. No. 12/742,907, which was filed on Oct. 1, 2010, which claims priority from International Patent Application No. PCT/EP2008/009714 which was filed on Nov. 17, 2008 and published in English as International Publication No. WO 2009/065542 A1 on May 28, 2009, which claims priority from European Patent Application No. 07022602.2, entitled Speaker Localization filed on Nov. 21, 2007, which are incorporated herein by reference in its entirety.

FIELD OF INVENTION

The present invention relates to the digital processing of acoustic signals, in particular, speech signals. The invention more particularly relates to the localization of a source of a sound signal, e.g., the localization of a speaker.

BACKGROUND OF THE INVENTION

Electronic communication becomes more and more prevalent nowadays. For instance, automatic speech recognition and control comprising speaker identification/verification is commonly used in a variety of applications. Communication between different communication partners can be performed by means of microphones and loudspeakers in the context of communication systems, e.g., in-vehicle communication systems and hands-free telephone sets as well as audio/video conference systems. Speech signals detected by microphones, however, are often deteriorated by background noise that may or may not include speech signals of background speakers. High energy levels of background noise might cause failure of the communication process.

In the above applications, accurate localization of a speaker is often necessary or at least desirable for a reliable detection of a wanted signal and signal processing. In the context of video conferences it might be advantageous to automatically point a video camera to an actual speaker whose location can be estimated by means of microphone arrays.

In the art, speaker localization based on Generalized Cross Correlation (GCC) or by adaptive filters are known. In both methods two or more microphones are used by which phase shifted signal spectra are obtained. The phase shift is caused by the finite distance between the microphones.

Both methods aim to estimate the relative phasing of the microphones or the angle of incidence of detected speech in order to localize a speaker (for details see, e.g., G. Doblinger, "Localization and Tracking of Acoustical Sources", in Topics in Acoustic Echo and Noise Control, pp. 91-122, Eds. E. Hansler and G. Schmidt, Berlin, Germany, 2006; Y. Huang et al., "Microphone Arrays for Video Camera Steering", in Acoustic Signal Processing for Telecommunication, pp. 239-259, S. Gay and J Benesty (Eds.), Kluwer, Boston, Mass., USA, 2000; C. H. Knapp and G. C. Carter, "The generalized correlation method for estimation of time delay", IEEE Trans. on Acoustics, Speech and Signal Processing, vol. 24, no. 4, pp. 320-327, August, 1976). In the adaptive filtering approach, it is basically intended to filter one microphone signal to obtain a model of the other one. The appropriately adapted filter coefficients include the information necessary for estimating the time delay between both microphone signals and thus allow for an estimate of the angle of incidence of sound.

The GCC method is expensive in that it gives estimates for time delays between different microphone signals that comprise unphysical values. Moreover, a fixed discretization in time is necessary. Speaker localization by adaptive filters can be performed in the frequency domain in order to keep the processor load reasonably low. The filter is realized by sub-band filter functions and can be temporarily adapted to account for time-dependent and/or frequency-dependent noise (signal-to-noise ratio).

However, even processing in the frequency-domain is time-consuming and demands for relatively large memory capacities, since the scalar filter functions (factors) have to be realized by means of high-order Fast Fourier Transforms in order to guarantee a sufficiently realistic modeling of the impulse response. The corresponding Inverse Fast Fourier Transforms are expensive. In addition, it is necessary to analyze the entire impulse response including late reflections that are to be taken into account for correct modeling of the impulse response but are of no use for the speaker localization.

Therefore, an improved method for speaker localization by means of multiple microphones is still desirable.

DESCRIPTION OF THE INVENTION

The above-mentioned problem is solved by the method for localizing a sound source, in particular, a human speaker, according to claim 1. The method comprises the steps of detecting sound generated by the sound source by means of a microphone array comprising more than two microphones and obtaining microphone signals, one for each of the microphones;

selecting from the microphone signals a pair of microphone signals for a predetermined frequency range based on the distance of the microphones to each other; and estimating the angle of incidence (with respect to the microphone array) of the detected sound generated by the sound source based on the selected pair of microphone signals.

In principle, the processing for speaker localization can be performed after transformation of the microphone signals to the frequency domain by a Discrete Fourier Transformation or, preferably, by sub-band filtering. Thus, according to one example the method comprises the steps of digitizing the microphone signals and dividing them into microphone sub-band signals (by means of appropriate filter banks, e.g., polyphase filter banks) before the step of selecting a pair of microphone signals for a predetermined frequency range. In this case, the selected pair of microphone signals is a pair of microphone sub-band signals selected for a particular sub-band depending on the frequency range of the sub-band.

Different from the art, speaker localization (herein this term is used for both the localization of a speaker or any other sound source) is obtained by the selection of two microphone signals obtained from two microphones of a microphone array wherein the selection is performed (by some logical circuit, etc.) according to a particular frequency range under consideration. The frequency range can be represented by an interval of frequencies, by a frequency sub-band, or a single particular frequency. Different or the same microphone signals can be selected for different frequency ranges. In particular, speaker localization may include only the selection of predetermined frequency ranges (e.g., frequencies above some predetermined threshold). Alternatively, speaker localization can be carried out based on a selection of a pair of microphones for frequency ranges, respectively, that cover the entire frequency range of the detected sound.

In particular, the above-mentioned selection of microphone signals might advantageously be carried out such that for a lower frequency range microphone signals coming from microphones that are separated from each other by a larger distance are selected and that for a higher frequency range microphone signals coming from microphones that are separated from each other by a smaller distance are selected for estimating the angle of incidence of the detected sound with respect to the microphone array. More particularly, for a frequency range above a predetermined frequency threshold a pair of microphone signals is selected coming from two microphones that are separated from each other by some distance below a predetermined distance threshold and vice versa.

Thus, for each frequency range a pair of microphone signals can be selected (depending of the distance of the microphones of the microphone array) that is particularly suited for an efficient (fast) and reliable speaker localization. Processing in the sub-band regime might be preferred, since it allows for a very efficient usage of computer resources.

The step of estimating the angle of incidence of the sound generated by the sound source advantageously may comprise determining a test function that depends on the angle of incidence of the sound. It is well known that in the course of digital time discrete signal processing in the sub-band domain, a discretized time signal g(n), where n is the discrete time index, can be represented by a Fourier series g(n)=

$$\sum_{\mu=-N/2+1}^{N/2-1} G_\mu e^{j\Omega_\mu n},$$

where N is the number of sub-bands (order of the discrete Fourier transform) and $\Omega_\mu$ denotes the μ-the sub-band, for an arbitrary test function $G_\mu$.

However, the present inventors realized that by means of the test function a function of the angle of incidence of the detected sound can directly be defined by $$g(\theta) = \sum_{\mu=-N/2+1}^{N/2-1} G_\mu e^{j\Omega_\mu \tau_\mu(\theta)},$$

where $\tau_\mu(\theta)$ denotes the frequency-dependent time delay between two microphone signals, i.e., in the present context, between the two microphone signals constituting the selected pair of microphone signals.

Consequently, measurement of a suitable test function $G_\mu$ by means of the microphone array allows to determine the function g(0) that provides a measure for the estimation of the angle of incidence of the detected sound with respect to the microphone array. In this context it should be noted that the employed microphone array advantageously comprises microphones that separated from each other by distances that are determined as a function of the frequency (nested microphone arrays). The microphones may be arranged in a straight line (linear array), whereas the microphone pairs may be chosen such that they share a common center to that the distances between particular microphones refers to. The distances between adjacent microphones do not need to be uniform.

In particular, for the desired speaker localization the test function can be employed in combination with a steering vector as known in the art of beamforming. A particular efficient measure for the estimation of the angle of incidence θ of the sound can be obtained by the scalar product of the test function and the complex conjugate of the steering vector $a=[a(e^{j\Omega_1}), a(e^{j\Omega_2}), \ldots, a(e^{j\Omega_{N/2-1}})]^T$, where the coefficients of the steering vector represent the differences of the phase shifts, i.e. the relative phasing, of the microphone signals of the selected pair of microphones for the μ-th sub-band (for details see description below). An estimate $\hat{\theta}$ for the angle of incidence θ can be obtained from $$\hat{\theta} = \underset{\theta}{\operatorname{argmax}}\{g(\theta)\},$$

where argmax denotes the operation that returns the argument for which the function g(θ) assumes a maximum.

The inventive procedure can be combined with both the conventional method for speaker localization based on the GCC algorithm and the conventional application of adaptive filters. For example, the test function can be a generalized cross power density spectrum of the selected pair of microphone signals (see detailed description below). The present inventive method is advantageous with respect to the conventional approach based on the cross correlation in that the test function readily provides a measure for the estimate of the angle of incidence of the generated sound without the need for an expensive complete Inverse Discrete Fourier Transformation (IDFT) that necessarily has to be performed in the latter approach that evaluates the cross correlation in the time domain (see, e.g., C. H. Knapp and G. C. Carter, "The generalized correlation method for estimation of time delay", IEEE Trans. on Acoustics, Speech and Signal Processing, vol. 24, no. 4, pp. 320-327, August, 1976). Moreover, evaluation a suitable measure for the estimate of the angle of incidence of the generated sound, e.g., obtained by the above-mentioned scalar product has to be only performed for a range of angles of interest thereby significantly increasing the speed of the speaker localization process.

According to another example, the herein disclosed approach is combined with the conventional method for speaker localization by means of adaptive filtering. In this case, the inventive method comprises filtering one of the selected pair of microphone signals by a first adaptive Finite Impulse Response (FIR) filtering means comprising first filter coefficients;

filtering the other one of the selected pair of microphone signals by a second adaptive Finite Impulse Response (FIR) filtering means comprising second filter coefficients; and the test function is constituted by selected ones of the filter coefficients either of the first or the second adaptive filtering means.

Again processing in the sub-band domain might be preferred. The numbers of the first and the second filter coefficients shall be the same. Different from standard speaker localization by adaptive filters, in the present embodiment for each sub-band an FIR filtering means comprising $N_{FIR}$ coefficients is employed thereby enhancing the reliability of the speaker localizing procedure.

It is of particular relevance that not all coefficients for one sub-band have to be used for constituting the test function but that only a small sub-set of the first or the second filter coefficients of the FIR filtering means is necessary for the speaker localization. According to one preferred embodiment the method comprises the step of normalizing the filter coefficients of one of the first and second adaptive filtering means such that the i-th coefficients, i being an integer, for each sub-band are maintained real (a real positive number) during the adaptation. In this case, the test function is constituted by the i-th coefficients of the other one of the first and second adaptive FIR filtering means (i.e. by the i-th coefficients of either the first or the second filter coefficients for each sub-band). As described below, e.g., the second coefficient of the second filtering means may be maintained real after initialization by 1, and the second coefficients of the first filtering means for each of the p sub-bands form the test function.

Different from the art employment of the full FIR filtering means for each sub-band allows for reliable modeling of reverberation. In particular, the i-th coefficients of first filtering means in each sub-band used for the generation of the test function represent the directly detected sound and, thus, this embodiment is particularly robust against reverberation.

In the art, adaptive filters have been realized by scalar filter functions. This, however, implies that high-order Discrete Fourier Transformations are necessary to achieve reliable impulse responses. This results in very expensive Inverse Discrete Fourier Transformations. In addition, the entire impulse responses including late reflections had to be analyzed in the art. Moreover, strictly speaking in the art the relationship between filter factors for the first and the second microphones have to be considered for the estimation of signal transit time differences. For instance, complex divisions of these filter factors are necessary which are relatively expensive operations. In the present invention, no complex divisions need to be involved in the generation and evaluation of the test function.

It should be noted that the above-described method for speaker localization by means of a test function and adaptive FIR filtering means can be employed in both nested microphone arrays and a simple two-microphone structure (in which case the selection of two appropriate microphone signals for a particular frequency range based on the distances of the microphones to each other is omitted). Again only a sub-set of filter coefficients has to be used for the speaker localization. Thus, it is provided a method for localizing a sound source, in particular, a human speaker, comprising the steps of detecting sound generated by the sound source by means of at least two microphones and obtaining microphone signals, one for each of the microphones;

filtering one of the microphone signals by a first adaptive FIR filtering means comprising a predetermined number of first filter coefficients;

filtering another one of microphone signals by a second adaptive FIR filtering means comprising a predetermined number of second filter coefficients;

normalizing the filter coefficients of one of the first and second adaptive filtering means such that the i-th coefficients, i being an integer, are maintained real during the adaptation; and estimating the angle of the incidence of the sound on the microphone array based on the i-th coefficients of the other one of the first and second adaptive filtering means.

In both approaches weighting the filter coefficients of one of the first and second adaptive filtering means during the adaptation by $1-\epsilon$, $\epsilon$ being a positive real number less than 1, might be included. By this parameter the influence of sub-bands that have not been significantly excised for some period can be reduced (see explanation below).

According to an embodiment in one of the above-described examples the steps of defining a measure for the estimation of the angle of incidence of the sound generated by the sound source by means of the test function and evaluating this measure for a predetermined range of values of possible angles of incidence of the sound might be comprised.

It is advantageous not to evaluate information for all possible angles in order to localize a sound source, but rather to concentrate on possible angles one of which can reasonably be expected to be the actual angle of incidence of the detected sound. In the above-described examples, such a restricted search for this angle can readily be performed, since the measure based on the test function is available as a function of this angle. The parameter range (angular range) for the evaluation can, thus, easily be limited thereby accelerating the speaker localization.

The present invention also provides a signal processing means, comprising a microphone array, in particular, a nested microphone array, comprising more than two microphones each of which is configured to detect sound generated by a sound source and to obtain a microphone signal corresponding to the detected sound;

a control unit configured to select from the microphone signals a pair of microphone signals for a predetermined frequency range based on the distance of the microphones to each other; and a localization unit configured to estimate the angle of the incidence of the sound on the microphone array based on the selected pair of microphone signals.

The signal processing means may further comprise filter banks configured to divide the microphone signals corresponding to the detected sound into microphone sub-band signals. In this case, the control unit is configured to select from the microphone sub-band signals a pair of microphone sub-band signals and wherein the localization unit is configured to estimate the angle of the incidence of the sound on the microphone array based on the selected pair of microphone sub-band signals.

In one of the above examples for the herein provided signal processing means the localization unit may be configured to determine a test function that depends on the angle of incidence of the sound and to estimate the angle of incidence of the sound generated by the sound source on the basis of the test function.

Furthermore, in the signal processing the localization means may be configured to determine a generalized cross power density spectrum of the selected pair of microphone signals as the test function.

According to an embodiment incorporating adaptive filters the signal processing means may further comprise a first adaptive FIR filtering means comprising first filter coefficients and configured to filter one of the selected pair of microphone signals;

a second adaptive FIR filtering means comprising second filter coefficients and configured to filter the other one of the selected pair of microphone signals; and the test function can be constituted by selected ones of the first filter coefficients of the first adaptive filtering means or the second filter coefficients of the second adaptive FIR filtering means.

Moreover, it might be advantageous that the signal processing means further comprises a normalizing means configured to normalize the filter coefficients of one of the first and second adaptive FIR filtering means such that the i-th coefficients, i being an integer, are maintained real during the adaptation; and the localization unit might be configured to estimate the angle of the incidence of the sound on the microphone array based on the i-th coefficients of the other one of the first and second adaptive FIR filtering means in this case.

Alternatively, a signal processing means not including a microphone array is provided. According to this example, the signal processing means comprises at least two microphones each of which is configured to detect sound generated by a sound source and to obtain a microphone signal corresponding to the detected sound;

a first adaptive FIR filtering means comprising first filter coefficients and configured to filter one of the microphone signals;

a second adaptive FIR filtering means comprising second filter coefficients and configured to filter another other one of the microphone signals; and a normalizing means configured to normalize the filter coefficients of one of the first and second adaptive FIR filtering means such that the i-th coefficients, i being an integer, are maintained real during the adaptation; and a localization unit configured to estimate the angle of the incidence of the sound on the microphone array based on the i-th coefficients of the other one of the first and second adaptive FIR filtering means.

The above examples of the inventive signal processing means can advantageously be used in different communication systems that are designed for the processing, transmission, reception etc., of audio signals or speech signals. Thus, it is provided a speech recognition system and/or a speech recognition and control system comprising the signal processing means according to one of the above examples.

Moreover, it is provided a video conference system, comprising at least one video camera and the signal processing means as mentioned above and, in addition, a control means that is configured to point the at least one video camera to a direction determined from the estimated angle of incidence of the sound generated by the sound source.

Additional features and for advantages of the present invention will be described in the following. In the description, reference is made to the accompanying figures that are meant to illustrate examples of the invention. It is understood that such examples do not represent the full scope of the invention.

In the following examples, signal processing is performed in the frequency domain. When two microphones detect sound s(t) from a sound source, in particular, the utterance of a speaker, the digitized microphone signals are filtered by an analysis filter bank to obtain the discrete spectra $X_1(e^{j\Omega_\mu})$ and $X_2(e^{j\Omega_\mu})$ for the microphone signals $x_1(t)$ and $x_2(t)$ of the two microphones separated from each other by some distance $d_{Mic}$ $$X_1(e^{j\Omega_\mu})=S(e^{j\Omega_\mu})e^{-j\Omega_\mu\tau_1}+N_1(e^{j\Omega_\mu})$$

$$X_2(e^{j\Omega_\mu})=S(e^{j\Omega_\mu})e^{-j\Omega_\mu\tau_2}+N_2(e^{j\Omega_\mu})$$

where $S(e^{j\Omega_\mu})$ denotes the Fourier spectrum of the detected sound s(t) and $N_1(e^{j\Omega_\mu})$ and $N_2(e^{j\Omega_\mu})$ denote uncorrelated noise in the frequency domain. The frequency sub-band are indicated by $\Omega_\mu$, $\mu=1, \ldots, N$. The exponential factors represent the phase shifts of the received signals due to different positions of the microphones with respect to the speaker. In fact, the microphone signals are sampled signals with some discrete time index n and, thus, a Discrete Fourier Transform is suitable for obtaining the above spectra. The difference of the phase shifts, i.e. the relative phasing, of the microphone signals for the μ-th sub-band reads $$a(e^{j\Omega_\mu}) = \frac{e^{-j\Omega_\mu\tau_1}}{e^{-j\Omega_\mu\tau_2}} = e^{-j\Omega_\mu\tau} = e^{-j\Phi}$$

with the phase shift $\phi$.

Figure 1:
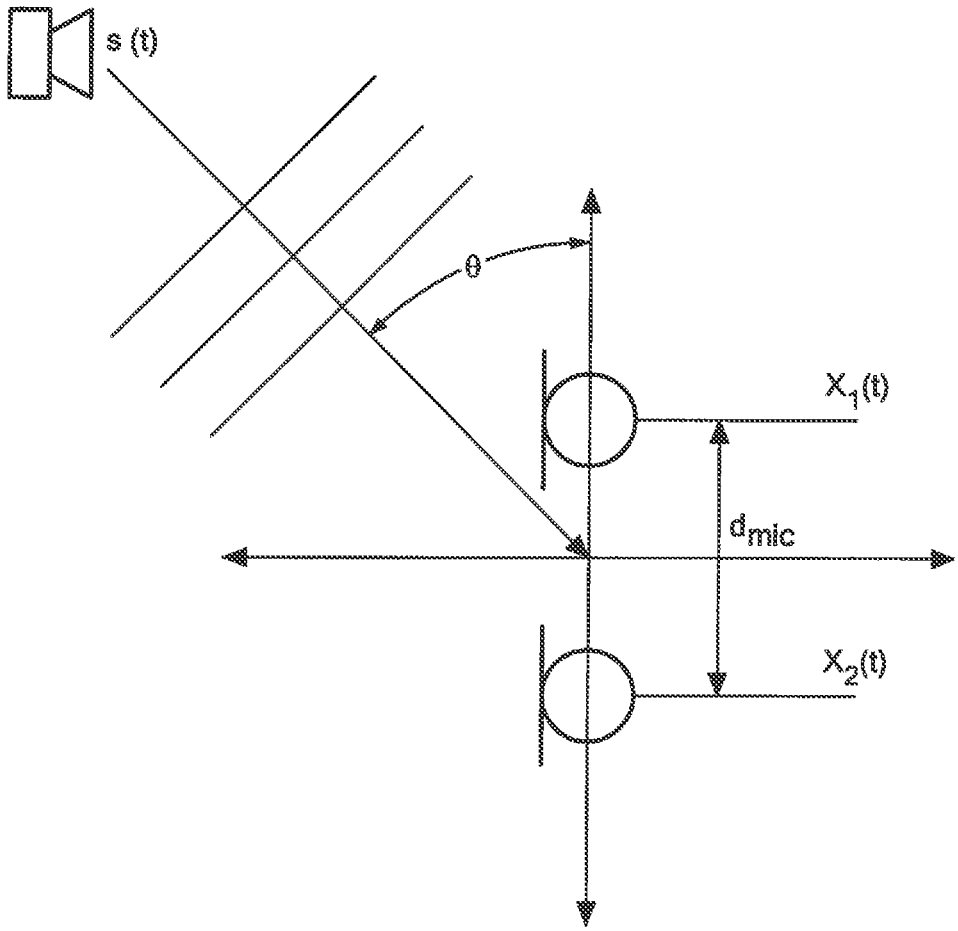
FIG. 1 illustrates the incidence of sound on a microphone array comprising microphones with predetermined distances from each other.

The relative time shift $\Delta t$ between the microphone signals in the time domain gives $$\tau = \frac{d_{Mic}}{cT_s}\cos(\theta) = \frac{\Delta t}{T_s}$$

with the sampling interval given by $T_s$ and c denoting the sound velocity. The angle of incident of sound (speech) detected by a microphone is denoted by θ. FIG. 1 illustrates the incidence of sound s(t) (approximated by a plane sound wave) on a microphone array comprising microphones arranged in a predetermined plane. Two microphones are shown in FIG. 1 that provide the microphone signals $x_1(t)$ and $x_2(t)$.

The above equation for the relative phasing shows that the lower the frequency the lower is the difference of the phase shifts of the two microphone signals. Noise contributions in the low-frequency range can therefore heavily affect conventional methods for speaker localization (Generalized Cross Correlation and adaptive filtering). In fact, in many practical applications it is the low-frequency range (below some 100 Hz) that is most affected by perturbations. In order to obtain a wide band detection of possible values for the phase shift $\phi$, in particular, at low frequencies, in the present example the microphone distance $d_{Mic}$ of two microphones used for the speaker localization is chosen in dependence on the frequency (see description below).

In order to increase the phase shift $\phi$ at low frequencies the microphone distances $d_{Mic}$ between the microphones of a microphone array shall be varied according to $d_{Mic}\sim 1/\Omega_\mu$. This implies $\tau_\mu(\theta)\sim 1/\Omega_\mu$, where the index μ indicates the frequency-dependence of the time delay, and accordingly $a(e^{j\Omega_\mu},\theta)=e^{-j\Omega_\mu\tau_\mu(\theta)}$. The actual microphone distances that are to be chosen depend on the kind of application. In view of $$\theta = \arccos\left(\frac{cT_s\tau}{d_{Mic}}\right),$$

which implies that a microphone distance resulting in $\tau\leq 1$ allows for a unique assignment of an angle of incident of sound to a respective time delay, the microphone distances might be chosen such that the condition $|\Omega_\mu\tau_\mu(\theta))|\leq\pi$ is fulfilled for a large angular range. By such a choice only a few ambiguities of the determined angle of incidence of sound would arise.

In the art, however, microphone arrays with microphones separated from each other by distances that are determined as a function of the frequency (nested microphone arrays) could not be employed for speaker localization. Due to the frequency-dependence of the time delay $\tau$ the conventional methods for speaker localization cannot make use of nested microphone arrays, since there is no unique mapping of the time delay to the angle of incidence of the sound after the processing in the time domain for achieving a time delay. The present invention provides a solution for this problem by a generic method for estimating the angle of incident of sound $\theta$ as follows.

In principle, the time-dependent signal g(t) that is sampled to obtain a band limited signal g(n) with spectrum $G_\mu$, can be expanded into a Fourier series $$g(t) = \sum_{\mu=-\infty}^{\infty} G_\mu e^{j\Omega_\mu t/T_s}$$

with the sampling time denoted by $T_s$. This expression can be directly re-formulated (see formula for the relative time shift $\Delta t$ above) as a function of the angle of incidence $$g(\theta) = \sum_{\mu=-N/2+1}^{N/2-1} G_\mu e^{j\Omega_\mu \tau_\mu(\theta)}$$

where it is taken into account that g(n) corresponding to g(t) is in praxis a bandlimited signal and that, thus, only a finite summation is to be performed. The expression $g(\theta)$ can be evaluated for each angle of interest. With the above formula for the relative phasing one obtains $$g(\theta) = \sum_{\mu=-N/2+1}^{N/2-1} G_\mu a*(e^{j\Omega_\mu}, \theta),$$

where the asterisk indicates the complex conjugate. When an arbitrary test function (spectrum) $G_\mu$ of a band limited signal that is discretized in time is measured by a nested microphone array, it can, thus, directly be transformed in a function of the angle $\theta$ that can be evaluated for any frequency range of interest.

Since $g(\theta)$ is a real function it can be calculated from $$g(\theta) = G_0 + 2\cdot \mathrm{Re}\left\{\sum_{\mu=1}^{N/2-1} G_\mu a*(e^{j\Omega_\mu}, \theta)\right\},$$

where the first summand $G_0$ includes no information on the phase. The second summand represents the real part of the scalar product of the test function and the complex conjugate of the steering vector $a=[a(e^{j\Omega_1}), a(e^{j\Omega_2}), \ldots, a(e^{j\Omega_{n/2-1}})]^T$ (the upper index T denotes the transposition operation).

An efficient measure for the estimation of the angle of incident can, e.g., be defined by $$\gamma(\theta) = \mathrm{Re}\left\{\sum_{\mu=1}^{N/2-1} C_\mu G_\mu a*(e^{j\Omega_\mu}, \theta)\right\}$$

where by $C_\mu$ (a so-called score function) summands can be weighted in accordance with the signal-to-noise ratio (SNR) in the respective sub-band, for instance. Other ways to determine the weights $C_\mu$, such as the coherence, may also be chosen. The angle $\theta$ for which $\gamma(\theta)$ assumes a maximum is determined to be the estimated angle $\hat{\theta}$ of incidence of sound s(t), i.e. according to the present example $$\hat{\theta} = \underset{\theta}{\mathrm{argmax}}\{\gamma(\theta)\}.$$

The above relation has to be evaluated only for angles of interest. Moreover, the function $\gamma(\theta)$ is readily obtained from the above-relation of $g(\theta)$ to g(n). Any suitable test function $G_\mu$ can be used. In particular, the above method can be combined with the conventional GCC method, i.e. the generalized cross power density spectrum can be used for the test function $$G_\mu = \Psi(\Omega_\mu) X_1(e^{j\Omega_\mu}) X_2*(e^{j\Omega_\mu})$$

where $\Psi(\Omega_\mu)$ is an appropriate weighting function (see, e.g., Knapp and G. C. Carter, "The generalized correlation method for estimation of time delay", IEEE Trans. on Acoustics, Speech and Signal Processing, vol. 24, no. 4, pp. 320-327, August, 1976). For instance, the so-called PHAT function can be used herein $$\Psi(\Omega_\mu) = \frac{1}{|X_1(e^{j\Omega_\mu}) X_2*(e^{j\Omega_\mu})|}.$$

In this case, one has to evaluate $$\hat{\theta} = \underset{\theta}{\mathrm{argmax}}\left\{\mathrm{Re}\sum_{\mu=1}^{N/2-1} \frac{C_\mu X_1(e^{j\Omega_\mu}) X_2*(e^{j\Omega_\mu}) a*(e^{j\Omega_\mu}, \theta)}{|X_1(e^{j\Omega_\mu}) X_2*(e^{j\Omega_\mu})|}\right\}.$$

for speaker localization.

It should be noted that in a case in which K>2 microphones are separated from each other by the same distance $d_{Mic}$, a spatially averaged cross correlation can be used for the test function $$G_\mu = \frac{\Psi(\Omega_\mu)}{K-1} \sum_{m=1}^{K-1} X_m(e^{j\Omega_\mu}) X_{m+1}^*(e^{j\Omega_\mu}).$$

Alternatively, the above-described method can be combined with adaptive filtering as it will be explained in the following with reference to FIG. 2. M microphone signals $x_1(n)$ to $x_M(n)$ (n being the discrete time index) obtained by M microphones 1 of a microphone array are input in analysis filter banks 2. In the present example, polyphase filter banks 2 are used to obtain microphone sub-band signals $X_1(e^{j\Omega_\mu},n)$ to $X_M(e^{j\Omega_\mu},n)$.

Figure 3:
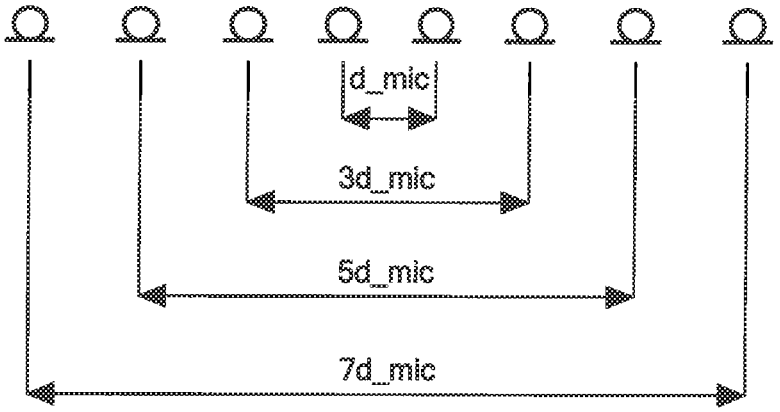
FIG. 3 shows a linear microphone array that can be used in accordance with the present invention.

In the present examples, a microphone array may be used in that the microphones are arranged in a straight line (linear array). The microphone pairs may be chosen such that they share a common center (see FIG. 3). The distances between adjacent microphones can be measured with respect to the common center. However, the distances do not need to be uniform throughout the array.

Thus, for each sub-band a pair of microphone sub-band signals is selected by a control unit 3. The selection is performed such that for a low-frequency range (e.g., below some hundred Hz) microphone sub-band signals are paired that are obtained from microphones that are spaced apart from each other at a greater distance than the ones from which microphone sub-band signals are paired for a high-frequency range (e.g., above some hundred Hz or above 1 kHz). The selection of a relatively larger distance of the microphones used for the low-frequency range takes into account that the wavelengths of low-frequency sound are larger that the ones of high-frequency sound (e.g. speech).

For a particular frequency sub-band p a pair of signals $X_a(e^{j\Omega_\mu},n)$ and $X_b(e^{j\Omega_\mu},n)$ is obtained by the control unit 3.

The pair of signals $X_a(e^{j\Omega_\mu},n)$ and $X_b(e^{j\Omega_\mu},n)$ is subject to adaptive filtering by a kind of a double-filter architecture (see, e.g., G. Doblinger, "Localization and Tracking of Acoustical Sources", in Topics in Acoustic Echo and Noise Control, pp. 91-122, Eds. E. Hänsler and G. Schmidt, Berlin, Germany, 2006). According to this structure, one of the filters is used to filter the signal $X_b(e^{j\Omega_\mu},n)$ to obtain a replica of the signal $X_a(e^{j\Omega_\mu},n)$. The adapted impulse response of this filter allows for estimating the signal time delay between the microphone signals $X_a(n)$ and $X_b(n)$ corresponding to the microphone sub-band signals $X_a(e^{j\Omega_\mu},n)$ and $X_b(e^{j\Omega_\mu},n)$. The other filter is used to account for damping that is possibly present in $x_b(n)$ but not in $x_a(n)$.

However, different from the art (e.g., described in the above reference), in the present example FIR filters with $N_{FIR}$ coefficients for each sub-band p are employed $$\hat{H}_1(e^{j\Omega_\mu},n)=\left[\hat{H}_{1,0}(e^{j\Omega_\mu},n),\ \ldots\ ,\hat{H}_{1,N_{FIR}-1}(e^{j\Omega_\mu},n)\right]^T$$

$$\hat{H}_2(e^{j\Omega_\mu},n)=\left[\hat{H}_{2,0}(e^{j\Omega_\mu},n),\ \ldots\ ,\hat{H}_{2,N_{FIR}-1}(e^{j\Omega_\mu},n)\right]^T$$

where the upper index T denotes the transposition operation. These filters $\hat{H}_1(e^{j\Omega_\mu},n)$ and $\hat{H}_2(e^{j\Omega_\mu},n)$ are adapted in unit 4 by means of the actual power density spectrum of the error signal $E(e^{j\Omega_\mu},n)$.

A first step of the adaptation of the filter coefficients might be performed by any method known on the art, e.g., by the Normalized Least Mean Square (NLMS) or Recursive Least Means Square algorithms (see, e.g., E. Hänsler and G. Schmidt: "Acoustic Echo and Noise Control—A Practical Approach", John Wiley, & Sons, Hoboken, N.J., USA, 2004). By the first step of the adaptation new filter vectors at time n, $\tilde{H}_1(e^{j\Omega_\mu},n)$ and $\tilde{H}_2(e^{j\Omega_\mu},n)$, are derived from previous obtained filter vectors at time n−1, $\hat{H}_1(e^{j\Omega_\mu},n-1)$ and $\hat{H}_2(e^{j\Omega_\mu},n-1)$, respectively. In order to avoid the trivial adaptation $\hat{H}_1(e^{j\Omega_\mu},n)=\hat{H}_2(e^{j\Omega_\mu},n)=0$, $\tilde{H}_1(e^{j\Omega_\mu},n)$ and $\tilde{H}_2(e^{j\Omega_\mu},n)$ are normalized in a normalizing unit 6, e.g., according to $$\breve{H}_1(e^{j\Omega_\mu},n)=\frac{\tilde{H}_1(e^{j\Omega_\mu},n)}{\sqrt{\left\|\tilde{H}_1(e^{j\Omega_\mu},n)\right\|_2^2+\left\|\tilde{H}_2(e^{j\Omega_\mu},n)\right\|_2^2}}$$

$$\breve{H}_1(e^{j\Omega_\mu},n)=\frac{\tilde{H}_2(e^{j\Omega_\mu},n)}{\sqrt{\left\|\tilde{H}_1(e^{j\Omega_\mu},n)\right\|_2^2+\left\|\tilde{H}_2(e^{j\Omega_\mu},n)\right\|_2^2}}$$

where $\|\ \|_2$ denotes the $L_2$ norm. Calculation of the square root of the $L_2$ norm can be replaced by a more simple normalization in order to save computing time $$\sqrt{\left\|\tilde{H}_1(e^{j\Omega_\mu},n)\right\|_2^2+\left\|\tilde{H}_2(e^{j\Omega_\mu},n)\right\|_2^2}\approx\sum_{i=0}^{N_{FIR}}\left\{\left|\mathrm{Re}\{\tilde{H}_{1,i}(e^{j\Omega_\mu},n)\}\right|+\left|\mathrm{Im}(\tilde{H}_{1,i}(e^{j\Omega_\mu},n)\}\right|+\left|\mathrm{Re}\{\tilde{H}_{2,i}(e^{j\Omega_\mu},n)\}\right|+\left|\mathrm{Im}(\tilde{H}_{2,i}(e^{j\Omega_\mu},n)\}\right|\right\}$$

which is sufficient for the purpose of avoiding a trivial solution for the filter vectors, i.e. $\hat{H}_1(e^{j\Omega_\mu},n)=\hat{H}_2(e^{j\Omega_\mu},n)=0$. The microphone sub-band signals $X_a(e^{j\Omega_\mu},n)$ and $X_b(e^{j\Omega_\mu},n)$ are filtered in unit 5 by means of the adapted filter functions.

In the present example, however, a second normalization with respect to the initialization of both filters is performed in addition to the first normalizing procedure. One of the filters, e.g., the first filter $\hat{H}_1(e^{j\Omega_\mu},n)$ used for filtering $X_a(e^{j\Omega_\mu},n)$, is initialized by the zero vector, i.e., $\hat{H}_1(e^{j\Omega_\mu},0)=0$. The other filter $\hat{H}_2(e^{j\Omega_\mu},n)$ is also initialized by zeros with the exception of one index $i_0$, e.g., the second index, $i_0=2$, where it is initialized by 1: $\hat{H}_2(ee^{j\Omega_\mu},0)=[0,1,0,\ldots,0]^T$. The second normalization is chosen such that at the index initialized by 1 (in this example the second index, $i_0=2$) the filter coefficients of the second filter maintain real in all sub-bands during the adaptation process. Thereby, the entire phase information is included in the first filter $\hat{H}_1(e^{j\Omega_\mu},n)$.

Thus, speaker localization can be restricted to the analysis of the first filter rather than analyzing the relation between both filters (e.g., the ratio) as known on the art. Processing time and memory resources are consequently reduced. For instance, a suitable second normalization performed by unit 6 reads $$\hat{H}_1(e^{j\Omega_\mu},n)=\breve{H}_1(e^{j\Omega_\mu},n)H_{norm}(e^{j\Omega_\mu},n)(1-\varepsilon)$$

$$\hat{H}_2(e^{j\Omega_\mu},n)=\breve{H}_2(e^{j\Omega_\mu},n)H_{norm}(e^{j\Omega_\mu},n)$$

with $$H_{norm}(e^{j\Omega_\mu},n)=\frac{\breve{H}_{2,i_0}^*(e^{j\Omega_\mu},n)}{\left|\mathrm{Re}\left\{\breve{H}_{2,i_0}^*(e^{j\Omega_\mu},n)\right\}\right|+\left|\mathrm{Im}\left\{\breve{H}_{2,i_0}^*(e^{j\Omega_\mu},n)\right\}\right|}$$

where a contraction by the real positive parameter $\epsilon<1$ is included in order to reduce the influence of sub-bands that have not been significantly excised for some period. This feature significantly improves the tracking characteristics in the case of a moving speaker (or sound source, in general). Given a typical sampling rate of 11025 Hz and a frame offset of 64, experiments have shown that a choice of $\epsilon\approx0.01$ is advantageous for a reliable speaker localization.

The contraction by the parameter c also allows for a reliability check of the result of $$\hat{\theta}=\underset{\theta}{\mathrm{argmax}}\{\gamma(\theta)\}.$$

If all sub-bands are continuously excited, the coefficients of the first filter converge to a fixed maximal value in each sub-band (experiments have shown values of about 0.5 up to 0.7 are reached). If the filter coefficients of the first filter are no longer adapted for some significant time period, they converge to zero. Consequently, the detection result $\gamma(\theta)$ shall vary between some maximum value (indicating a good convergence in all sub-bands) and zero (no convergence at all) and can, thus, be used as a confidence measure.

By the employment of complete FIR filters rather than scalar filter functions per sub-band a better model of reverberation of the acoustic room is achieved. In particular, for the speaker localization only one of the $N_{FIR}$ coefficients per sub-band is needed, namely, the one corresponding to the sound coming directly from the sound source (speaker). Due to the above normalization, the contribution of this direct sound to the signal s(t) detected by the microphones 1 substantially affects the filter coefficients (for each sub-band) with the index $i_0$.

Different from the art it is only this small portion of the entire impulse response that has to be analyzed for estimating the speaker location. Consequently, the method is very robust against any reverberation. The test function $G_\mu$, for this example, is simply given by $$G_\mu = \hat{H}_{dir}(e^{j\Omega_\mu}, n) = \left[\hat{H}_{1,i_0}(e^{j\Omega_0}, n), \ldots, \hat{H}_{1,i_0}(e^{j\Omega_{N/2-1}}, n)\right]^T.$$

Figure 2:
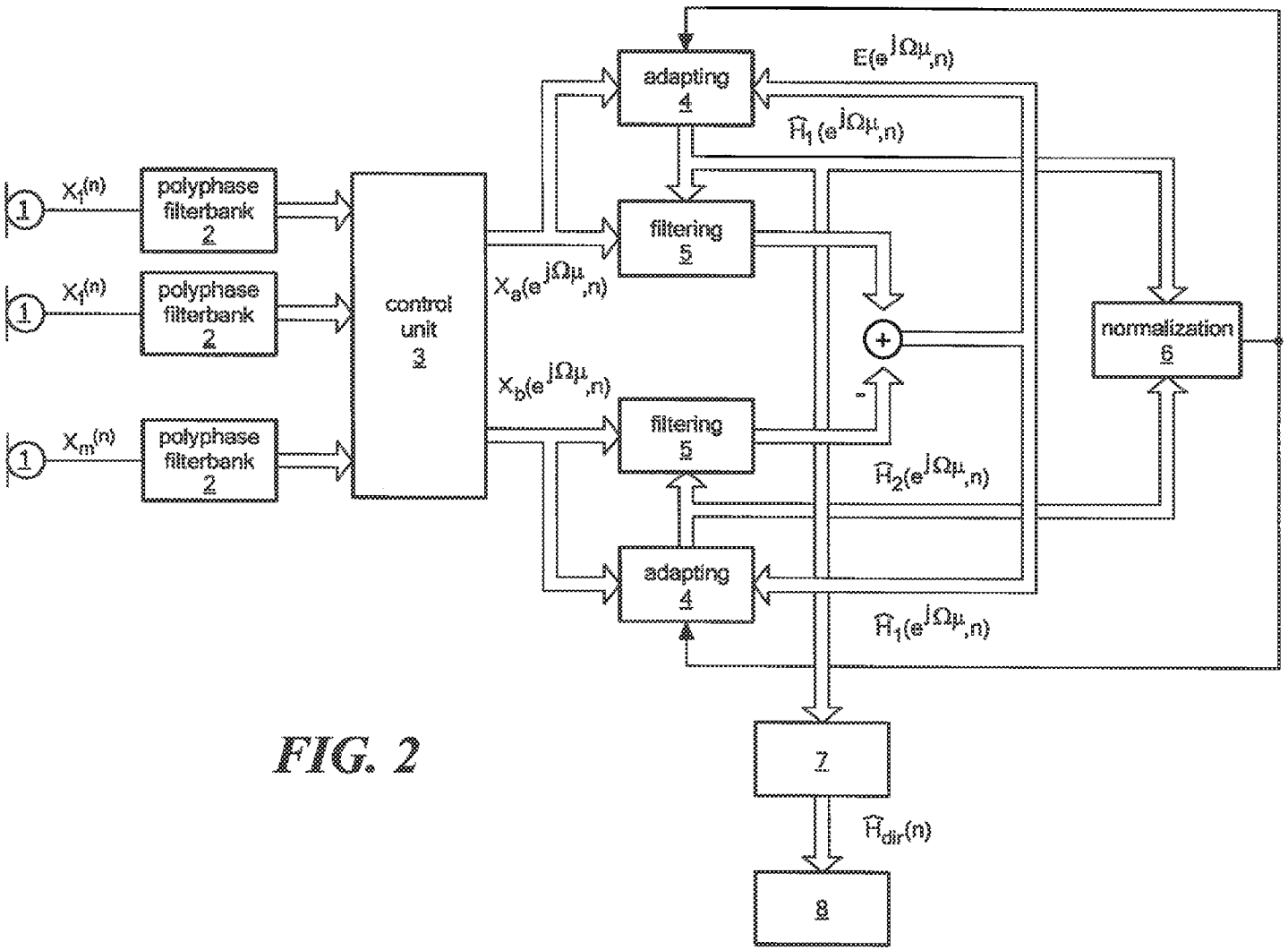
FIG. 2 illustrates an example of a realization of the herein disclosed method for localizing a sound source, in particular, a speaker, comprising a frequency-dependent selection of particular microphones of a microphone array and adaptive filtering.

Thus, the $i_0$ coefficients are selected from the adapted $\hat{H}_1(e^{j\Omega_\mu},n)$ in unit 7 of FIG. 2 and they are used for the speaker localization by evaluating $$\hat{\theta} = \underset{\theta}{\operatorname{argmax}}\{\gamma(\theta)\}$$

in unit 8.

Whereas the example described with reference to FIG. 2 includes multiple microphones of a microphone array, e.g., a nested microphone array, employment of FIR filters and the second normalization can also be applied to the case of just two microphones thereby improving the reliability of a conventional approach for speaker localization by means of adaptive filtering. Obviously, the control unit 3 is not necessary in the case of only two microphones.

All previously discussed examples are not intended as limitations but serve as examples illustrating features and advantages of the invention. It is to be understood that some or all of the above described features can also be combined in different ways.

What is claimed:

1. A method, comprising:

receiving a sound signal from a sound source at first and second microphones forming at least part of a microphone array, wherein the first microphone provides a first microphone signal and the second microphone provides a second microphone signal, wherein the first microphone is located at a first position and the second microphone is located at a second position in relation to the first position;

determining phase shift information between the first and second microphone signals for the sound signal; and determining an angle of incidence of the sound in relation to the first and second positions of the first and second microphones from the phase shift information and a band-limited test signal received by the first and second microphones for a frequency range of interest; and selecting the first and second position based upon frequency.

2. The method according to claim 1, farther including determining the estimated angle of incidence from a maximum of evaluated angles of interest.

3. The method according to claim 1, further including performing sub-band weighting based upon SNR.

4. The method according to claim 1, further including performing weighting based on coherence.

5. The method according to claim 1, wherein the test signal corresponds to a generalized cross correlation (GCC) function.

6. The method according to claim 1, wherein the first and second microphones have a common center.

7. The method according to claim 1, further including filtering the first and second microphone signals with a first FIR filter and filtering third and fourth microphone signals with a second FIR filter.

8. The method according to claim 1, wherein the microphone array further includes nested microphones, wherein the first and second microphones form a first nested microphone pair.

9. An article, comprising:

a non-transitory computer readable medium having stored instructions that enable a machine to:

receive a sound signal from a sound source at first and second microphones forming at least part of a microphone array, wherein the first microphone provides a first microphone signal and the second microphone provides a second microphone signal, wherein the first microphone is located at a first position and the second microphone is located at a second position in relation to the first position;

determine phase shift information between the first and second microphone signals for the sound signal; and determine an angle of incidence of the sound in relation to the first and second positions of the first and second microphones from the phase shift information and a band-limited test signal received by the first and second microphones for a frequency range of interest; and select the first and second positions based on frequency.

10. The article according to claim 9, further including instructions to determine the estimated angle of incidence from a maximum of evaluated angles of interest.

11. The article according to claim 9, father including instructions to perform sub-band weighting based upon SNR.

12. The article according to claim 9, further including instructions to perform weighting based on coherence.

13. The article according to claim 9, further including instructions to select the first and second positions based upon frequency.

14. The article according to claim 9, wherein the test signal corresponds to a generalized cross correlation (GCC) function.

15. The article according to claim 9, wherein the first and second microphones have a common center.

16. The article according to claim 9, further including instructions to filter the first and second microphone signals with a first FIR filter and filtering third and fourth microphone signals with a second FIR filter.

17. The article according to claim 9, wherein the microphone array further includes nested microphones, wherein the first and second microphones form a first nested microphone pair.

18. A system, comprising:

a processor and a memory configured to:

for a sound signal received from a sound source at first and second microphones forming at least part of a microphone array, wherein the first microphone provides a first microphone signal and the second microphone provides a second microphone signal, wherein the first microphone is located at a first position and the second microphone is located at a second position in relation to the first position, determine phase shift information between the first and second microphone signals for the sound signal; and determine an angle of incidence of the sound in relation to the first and second positions of the first and second microphones from the phase shift information and a band-limited test signal received by the first and second microphones for a frequency range of interest.

19. The system according to claim 18, wherein the processor is further configured to determine the estimated angle of incidence from a maximum of evaluated angles of interest; and select the first and second positions based on frequency.

* * * * *